US008469020B1

(12) United States Patent
Northrup

(10) Patent No.: US 8,469,020 B1
(45) Date of Patent: Jun. 25, 2013

(54) PORTABLE HEATER

(76) Inventor: Mark Northrup, Columbus, OH (US)

( * ) Notice: Subject to any disclaimer, the term of this patent is extended or adjusted under 35 U.S.C. 154(b) by 261 days.

(21) Appl. No.: 13/025,520

(22) Filed: Feb. 11, 2011

Related U.S. Application Data

(60) Provisional application No. 61/304,102, filed on Feb. 12, 2010.

(51) Int. Cl.
*F24C 3/00* (2006.01)

(52) U.S. Cl.
USPC ..... 126/85 R; 126/26; 126/25 B; 126/9 R; 431/142; 431/143

(58) Field of Classification Search
USPC ..... 126/85 R, 85 B, 59.5, 58, 59, 26, 126/25 R, 30, 9 R, 4, 11, 13, 38; 431/142, 431/143; 220/573.1, 573.3, 573.4, 573.5
See application file for complete search history.

(56) References Cited

U.S. PATENT DOCUMENTS 6,331,108 B1 * 12/2001 Stiner ..... 431/344
2008/0257877 A1 * 10/2008 Vandrak et al. ..... 219/209

* cited by examiner

*Primary Examiner* — Alfred Basichas
(74) *Attorney, Agent, or Firm* — James R. Eley; Michael A. Forhan; Eley Law Firm Co. LPA

(57) ABSTRACT

A portable heater has a housing with a base, an opposing open end, a sidewall extending between the base and the open end, an opening in the sidewall, and a lip in the sidewall proximate the open end. A fuel container support for receiving a fuel container is in the housing, proximate the base. A cover selectably coupled to the housing closes off the open end. The cover has a flue for receiving heat from a heating unit and directing the heat out of the housing.

18 Claims, 4 Drawing Sheets

PORTABLE HEATER

This application claims priority to U.S. Provisional Patent Application No. 61/304,102, filed Feb. 12, 2010, the entire contents of which are hereby incorporated by reference.

FIELD

The present invention relates generally to portable heaters, in particular to portable heaters fired by a self-contained, pressurized gas supply.

BACKGROUND

Portable, gas-fired heaters are often used by outdoorsmen and workmen to serve as space heaters in small areas. Such heaters are typically used to heat small, closed spaces such as, for example, a small shelter, a tent, a hunting blind, etc. Portable gas heaters may also be used as hand and body warmers in connection with outdoor activities such as ice fishing, skiing and sledding.

A drawback of current portable gas heaters is that they are often bulky and heavy, making their transport inconvenient and thus discouraging their use in connection with many outdoor activities. In addition, current portable gas heaters are relatively expensive. Furthermore, many portable gas heaters are somewhat unstable and are thus subject to accidental tipping. Yet another shortcoming of existing portable heaters is that they tend to emit a broad stream of heated air, rather than focusing the heated air into a single column.

SUMMARY

A portable heater is disclosed according to an embodiment of the present invention. A housing made from a bucket includes a user-accessible opening formed in a sidewall. A fuel container support sized and shaped to receive and support a self-contained pressurized gas supply is proximate a bottom portion of the housing. A gas heater is coupled to the gas supply and the assembly is placed into the fuel container support. A removable cover having a vertically adjustable flue is attached to the housing and directs heat generated by the gas heater out of the housing. In operation, a user may carry the portable heater by a handle of the housing to a place of desired use. The user accesses the controls of the gas heater through the opening in the sidewall of the housing to turn the heater on and off.

An object of the present invention is a portable heater. The portable heater has a housing with a base, an opposing open end, a sidewall extending between the base and the open end, an opening in the sidewall, and a lip in the sidewall proximate the open end. A fuel container support for receiving a fuel container is in the housing, proximate the base. A cover selectably coupled to the housing closes off the open end. The cover has a flue for receiving heat from a heating unit and directing the heat out of the housing.

A portable heater according to another object of the present invention comprises a housing having a base and an opposing open end, a sidewall extending between the base and the open end, a handle, an opening in the sidewall, and a lip in the sidewall at the open end. A fuel container support for receiving a fuel container is disposed in the housing proximate the base and has a generally horizontally-oriented support member with a support member opening and a generally hollow, cylindrical, vertically-oriented support collar extending through the support member. A cover is selectably coupled to the housing and closes off the open end, the cover having a flue for receiving heat from a heating unit and directing the heat out of the housing.

BRIEF DESCRIPTION OF THE DRAWINGS

Further features of the inventive embodiments will become apparent to those skilled in the art to which the embodiments relate from reading the specification and claims with reference to the accompanying drawings, in which:

DETAILED DESCRIPTION

Figure 1:
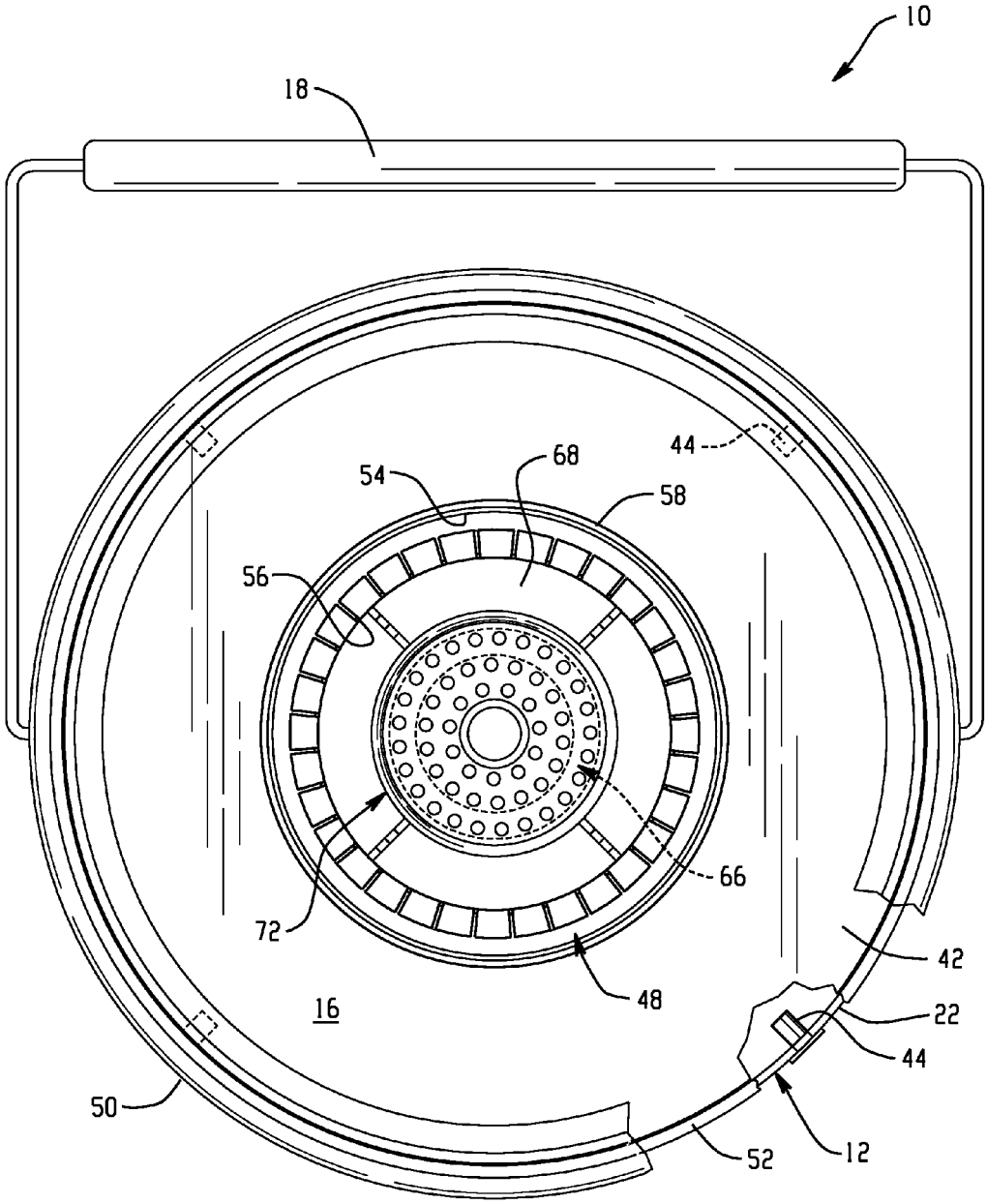
FIG. 1 is a top view of a portable heater according to an embodiment of the present invention.

In the discussion that follows, like reference numerals are used to describe like elements in the various figures.

Figure 2:
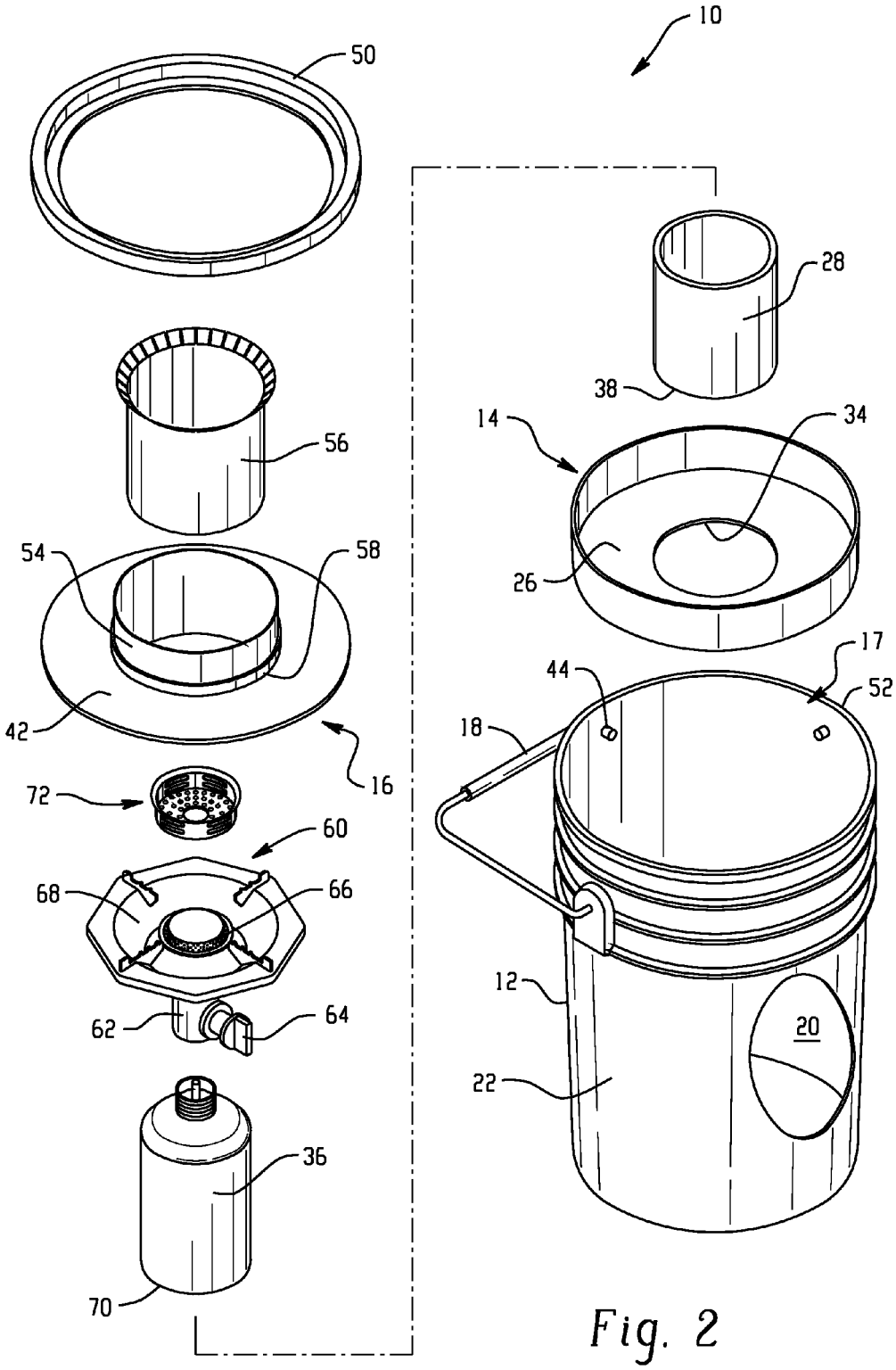
FIG. 2 is an exploded view showing the components of the portable heater of FIG. 1.
Figure 3:
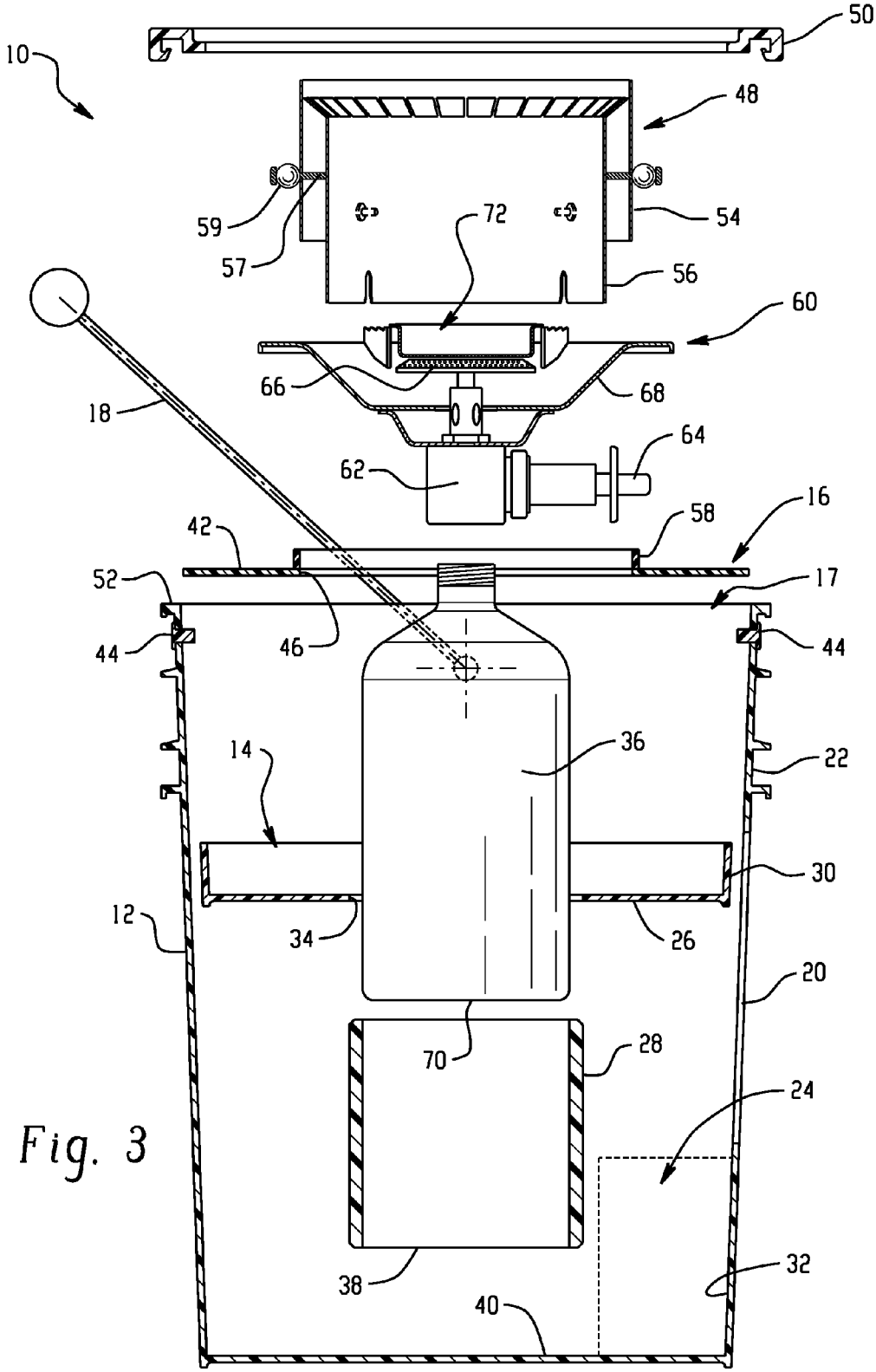
FIG. 3 is an exploded view in section of the components of FIG. 2.
Figure 4:
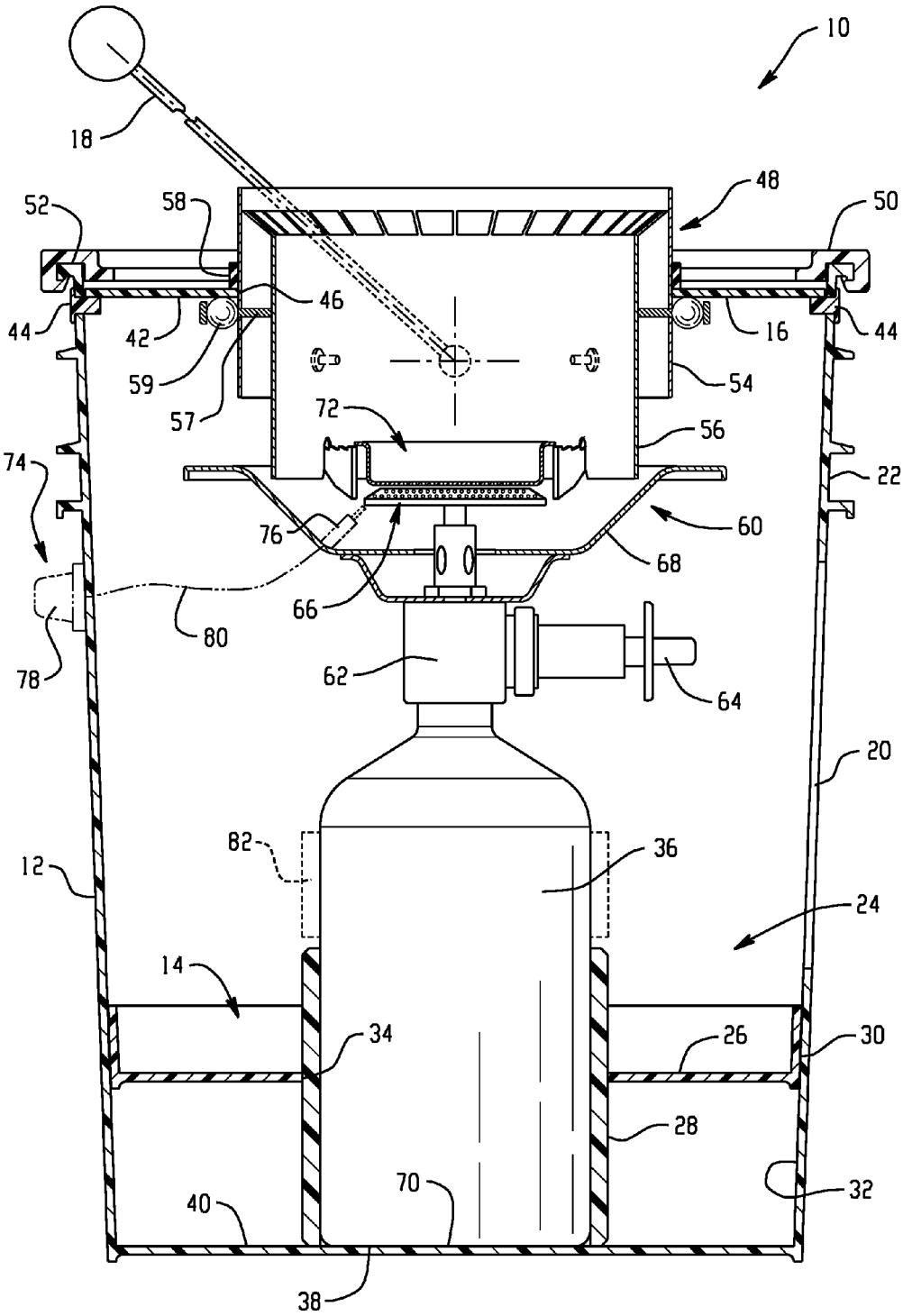
FIG. 4 is a view of the exploded components of FIG. 3 shown assembled.

The general arrangement of a portable heater 10 is shown in FIGS. 1 through 4 according to an embodiment of the present invention. Portable heater 10 includes a housing 12, a fuel container support 14, and a cover 16.

In one embodiment housing 12 is a bucket such as, but not limited to, a five-gallon bucket having an open end 17 and being adapted for use with the present invention. Alternatively, housing 12 may be purpose-made for use with portable heater 10. Housing 12 may be made from any type of material suitable for the expected use and environment including, without limitation, metal, plastic and composites. In addition, housing 12 may be formed in any conventional manner including, but not limited to, casting, machining, forming, molding and stamping. Furthermore, housing 12 may be finished in any conventional manner, such as painting, coating, plating, molded-in colors and decorative features, or may be left unfinished.

A sidewall opening 20 is formed in a sidewall 22 of housing 12 and is located, sized and shaped to allow a user access to internal components of portable heater 12 as discussed further below.

Housing 12 may include a carrying handle 18 for ease of transport of portable heater 10. Handle 18 is preferably coupled to housing 12 with any desired pivot axis that allows the handle to be pivoted away from sidewall opening 20 of the housing when portable heater 10 is in use. As non-limiting examples the pivot axis of handle 18 may be as shown in the figures, aligned with sidewall opening 20, or orthogonal to the opening.

In some embodiments housing 12 may include an externally accessible storage compartment 24 for storing ancillary items such as fishing tackle, food, clothing, etc. Alternatively, storage compartment 24 may be internal to housing 12 and made accessible to a user through housing sidewall opening 20.

Fuel container support 14 includes a generally horizontally-oriented, generally circularly-shaped support member 26 and a generally vertically-oriented, cylindrical, hollow support collar 28. Support member 26 has an outer diameter 30 sized to fit within an inner surface 32 of housing sidewall 22. Support member 26 also includes a support member opening 34 sized and shaped to receive support collar 28 therethrough. Support collar 28, in turn, is sized and shaped to receive and support in a generally vertical orientation a pressurized gas fuel container 36, a bottom 38 of the support collar resting upon a base 40 of housing 12.

Support member 26 and support collar 28 may be made as separate pieces and joined together with an interference fit between the support collar and support member opening 34. Alternatively, support member 26 and support collar 28 may be joined together with any suitable retaining means including, without limitation, an elastic band, adhesives and adjustable support clamps that tighten against a set of support brackets fixed to the support member, the support brackets being urged against the support collar by the support clamps to secure the support collar to the support member. In some embodiments support member 26 and support collar 28 may be formed as a single, integral piece.

The components of fuel container support 14 may be made from any type of material suitable for the expected use and environment including, without limitation, metal, plastic and composites. In addition, fuel container support 14 may be formed in any conventional manner including, but not limited to, casting, machining, forming, molding and stamping. Furthermore, fuel container support 14 may be finished in any conventional manner, such as painting, coating, plating, molded-in colors and decorative features, or may be left unfinished.

Cover 16 includes a closure 42 that is sized and shaped to rest upon a set of retaining fasteners 44 extending inwardly through sidewall 22 of housing 12, the closure closing off open end 17 of the housing. Alternatively, closure 42 may rest against an upper lip 50 formed in sidewall 22 of housing 12. Closure 42 also includes a flue opening 46 that is sized and shaped to receive a flue 48 therethrough. A fastening ring 50 selectably engages upper lip 52 of housing 12 to selectably secure closure 42 to housing 12.

Closure 42 may be made from any suitable material including, but not limited to, plastic, fiberglass, metal and composites. Likewise, fastening ring 50 may be made from any suitable plastic or elastic material. Furthermore, closure 42 and fastening ring 50 may be made as separate pieces or may be formed as a single, integral piece.

Flue 48 includes a hollow, cylindrical outer lining 54. A hollow, cylindrical inner lining 56 is fitted within outer lining 54 and is spaced apart from the outer lining, providing a space or gap between the linings. The space between linings 54, 56 may be an air-filled gap. Alternatively, the space between linings 54, 56 may be filled with a suitable thermally insulative material to reduce the transfer of heat from the inner lining to the outer lining. Linings 54, 56 may be separate pieces or may be made from a single piece. A set of spacer screws 57 control the spacing between inner and outer linings 54, 56. Each spacer screw 57 includes a thermally insulated support 59 for closure 42.

The components of flue 48 may be made from any type of material suitable for the expected use and environment including, without limitation, metal, plastic and composites. In addition, flue 48 may be formed in any conventional manner including, but not limited to, casting, machining, forming, molding and stamping. Furthermore, flue 48 may be finished in any conventional manner, such as painting, coating, plating, molded-in colors and decorative features, or may be left unfinished.

Flue 48 may be assembled to closure 42 by inserting the flue through flue opening 46 of the closure and securing the flue to the closure with one or more elastic bands 58. Elastic band 58 is preferably slightly smaller than outer lining 54, placing the elastic band in tension when coupled to outer lining 54. When installed to outer lining 54, elastic band 58 is preferably located adjacent closure 42, the elastic band allowing for vertical adjustment of the flue with respect to the closure while also retaining the flue at a set vertical position with respect to the closure. Alternatively, flue 48 may be assembled to closure 42 with any suitable fastening means including, without limitation, adhesives and adjustable clamps that tighten against a set of brackets fixed to the closure, the brackets being urged against the flue by the clamps to secure the flue to the closure.

A heating unit 60 of portable heater 10 is shown in FIGS. 1 through 4. Heating unit 60 includes a valve 62 having a control knob 64. Heating unit further includes a burner 66 and may optionally include a reflector 68. Heating unit 60 may be detachably coupled to an upper portion of fuel container 36 in any suitable manner, such as with mating threaded connectors. As a non-limiting example, a Model No. 2000004124 PERFECTFLOW or similar single-burner propane-fueled stove, supplied by the Coleman Company of Wichita, Kansas, may be adapted for heater 60. As another non-limiting example, a Model No. 2000004164 SPORTCAT or similar propane-fueled catalytic heater, also supplied by the Coleman Company, may be adapted for heater 60.

Fuel container 36 may be any size and shape suitable for insertion into support collar 28. In one embodiment of the present invention fuel container 36 is a pressurized propane fuel bottle.

With reference to FIGS. 1 through 4 together, portable heater 10 is assembled by inserting fuel container support 14 into housing 12 through open end 17 such that support member 26 engages inner surface 32 of the housing sidewall, with the bottom 38 of support collar 28 preferably contacting base 40 of the housing. Fuel container support 14 may be held in place by a slight interference between support member 26 and inner surface 32. Alternatively, fuel container support 14 may be selectably retained in housing 12 by a set of removable retaining fasteners similar to retaining fasteners 44, the retaining fasteners extending inwardly through sidewall 22 of housing 12 and through (or above) support member 26. In other embodiments of the present invention fuel container support 14 may be permanently affixed into position within housing 12 with adhesive or any other suitable securing means, or may be integral to the housing.

Heating unit 60 is attached to a fuel container 36, the resulting assembly being placed into housing 12 through open end 17 with a bottom end 70 of the fuel container being inserted into support collar 28 and resting upon base 40 of the housing. Control knob 64 of heating unit 60 is oriented toward housing sidewall opening 20 by rotating fuel container 36 as required, with burner 66 and reflector 68 of the heating unit being oriented upwardly toward open end 17 of the housing. Cover 16 is then selectably coupled to housing 12, closure 42 resting upon retaining fasteners 44 and fastening ring 50 engaging the upper lip. Flue 48 is vertically positioned over burner 66 and reflector 68, in close proximity thereto.

With continued reference to FIGS. 1 through 4, in operation portable heater 10 may be carried to a place of use with handle 18. Once in place, a user accesses the valve 62 control knob 64 through housing sidewall opening 20 and rotates the control knob to initiate the flow of gas from fuel container 36 to heating unit 60. An open flame or a spark generator, such as a piezoelectric igniter, is inserted into flue 48 proximate burner 66 and is used to ignite the flowing gas present at the burner. Burner 66 maintains an open heating flame, the amount of heat being generated by the burner being controlled by the quantity of gas flowing from fuel container 36. The quantity of gas flowing from fuel container 36 is in turn controlled by the position of control knob 64 of valve 62. Heat generated by burner 66 travels primarily upwardly by convection. Reflector 68 also directs radiated heat from burner 66 upwardly. The upwardly-flowing heat is coupled to flue 48, which is closely positioned to burner 66 and reflector 68. Flue 48 directs the heat out of housing 12 to warm the user.

When portable heater 10 is no longer needed the user again accesses control knob 64 of valve 62 through housing sidewall opening 20 and rotates the knob in an appropriate direction to stop the flow of gas from fuel container 36, thereby extinguishing the flame and effectively turning off heating unit 60.

When fuel container 36 is depleted of fuel a user may replace the fuel container by detaching cover 16 of housing 12, then removing the assembled fuel container and heating unit 60 from the housing through open end 17. Heating unit 60 is then detached from fuel container 36 and attached to a non-depleted fuel container. Portable heater 10 is then reassembled in the manner previously described.

Cold ambient temperatures may cause a reduction in the pressure in fuel container 36, resulting in reduced heat output from heating unit 60. To compensate for this, in some embodiments of the present invention a deflector 72 may be removably coupled to heating unit 60, proximate burner 66. Deflector 72 directs a portion of the heat generated by burner 66 to reflector 68, thereby indirectly heating fuel container 36 via the reflector to raise the pressure in the fuel container.

In an optional embodiment of the present invention a piezoelectric or other type of igniter 74 or a lighter may be permanently or removably coupled to portable heater 10. In this embodiment an igniter element 76 (shown in phantom line in FIG. 4) is placed proximate burner 66 and an actuator switch 78 is mounted to housing sidewall 22, accessible to a user. An electrical wire 80 extends between igniter element 76 and actuator switch 78. The user actuates switch 78, generating an ignition spark at igniter element 76 to ignite gas flowing to burner 66 from fuel container 36. Igniter 74 eliminates the need for the user to carry a separate ignition source to operate portable heater 10. In several embodiments igniter 74 may be mounted to housing 12, cover 16 or heating unit 60.

In another optional embodiment of the present invention a battery-powered heater such as an electric heating "sock" or wrap may be placed over or around fuel container 36 to raise the temperature of the fuel in the container at low ambient temperatures. Heating fuel container 36 in this manner raises the pressure in the fuel container and thus aids the flow of gas from the fuel container in low ambient temperature conditions.

Portable heater 10 may be supplied as a complete, ready-to-use unit. Alternatively, portable heater 10 may be supplied in kit form, with items such as fuel container 36 and heater 60 supplied by the user.

While this invention has been shown and described with respect to a detailed embodiment thereof, it will be understood by those skilled in the art that changes in form and detail thereof may be made without departing from the scope of the claims of the invention.

What is claimed is:

1. A portable heater, comprising:

a housing having a base and an opposing open end, a sidewall extending between the base and the open end, a carrying handle, an opening in the sidewall, and a lip in the sidewall proximate the open end;

a fuel container support in the housing proximate the base, the fuel container support having a generally horizontally-oriented support member with a support member opening and a generally hollow, cylindrical, vertically-oriented support collar extending through the support member;

a fuel container removably received by the support collar of the fuel container support;

a heating unit coupled to the fuel container, the heating unit including a burner and a reflector;

a plurality of retaining fasteners extending through the sidewall of the housing;

and a cover selectably coupled to the housing and closing off the open end, the cover having closure, a fastening ring, and a flue, the closure having a flue opening and resting upon the retaining fasteners, wherein the flue extends through the flue opening, the flue being configured to direct heat from the heating unit out of the housing, and the fastening ring being sized and shaped to selectably engage the lip of the housing, the fastening ring selectably securing the closure to the housing.

2. A method for providing a portable heater, comprising the steps of:

providing a housing having a base and an opposing open end, a sidewall extending between the base and the open end, an opening in the sidewall, and a lip in the sidewall proximate the open end;

placing a fuel container support in the housing proximate the base for receiving a fuel container;

extending a plurality of retaining fasteners through the sidewall of the housing;

providing a cover having a closure, a fastening ring, and a flue, the closure having a flue opening, the flue extending through the flue opening, the flue being configured for receiving heat from a heating unit and directing the heat out of the housing;

resting the closure upon the retaining fasteners; and selectably engaging the lip of the housing with the fastening ring, the fastening ring selectably securing the closure to the housing with the fastening ring to close off the open end.

3. The method of claim 2, further including the steps of:

placing a fuel container in the housing, the fuel container being removably received by the fuel container support; and coupling a heating unit to the fuel container.

4. A portable heater, comprising:

a housing having a base and an opposing open end, a sidewall extending between the base and the open end, an opening in the sidewall, and a lip in the sidewall proximate the open end;

a fuel container support in the housing proximate the base for receiving a fuel container;

a plurality of retaining fasteners extending through the sidewall of the housing; and a cover selectably coupled to the housing and closing off the open end, the cover having a closure, a fastening ring, and a flue, the closure having a flue opening and resting upon the retaining fasteners, wherein the flue extends through the flue opening, the flue being configured for receiving heat from a heating unit and directing the heat out of the housing, and the fastening ring being sized and shaped to selectably engage the lip of the housing, the fastening ring selectably securing the closure to the housing.

5. The portable heater of claim 1 wherein the housing further includes a carrying handle.

6. The portable heater of claim 1 wherein the fuel container support comprises:

a generally horizontally-oriented support member having a support member opening; and a generally hollow, cylindrical, vertically-oriented support collar extending through the support member.

7. The portable heater of claim 1, further comprising:

a fuel container removably received by the fuel container support; and a heating unit coupled to the fuel container.

8. The portable heater of claim 7 wherein the fuel container is a pressurized propane fuel bottle.

9. The portable heater of claim 7 wherein the heating unit further includes a burner.

10. The portable heater of claim 9 wherein the heating unit further includes a reflector proximate the burner.

11. The portable heater of claim 7 wherein the heating unit further includes a valve to control the flow of fuel from the fuel container to the heating unit.

12. The portable heater of claim 11 wherein the valve further includes a control knob to adjust the flow of fuel from the fuel container to the heating unit, the control knob being accessible through the opening in the sidewall of the housing.

13. The portable heater of claim 7, further comprising a deflector removably coupled to the heating unit, the deflector directing heat from the burner to the fuel container.

14. The portable heater of claim 7, further comprising a battery-powered heater proximate the fuel container.

15. The portable heater of claim 1, further including an elastic band coupled to the flue and adjacent the closure, the elastic band allowing vertical adjustment of the flue with respect to the closure, the elastic band further retaining the flue at a set vertical position with respect to the closure.

16. The portable heater of claim 1 wherein the flue further comprises an outer lining and an inner lining within the outer lining, the inner and outer linings being spaced apart from each other.

17. The portable heater of claim 1, further comprising an igniter.

18. The portable heater of claim 1 wherein the housing further includes a storage compartment.

* * * * *